US005176081A

United States Patent [19]

Buus

[11] Patent Number: 5,176,081

[45] Date of Patent: Jan. 5, 1993

[54] METHOD AND AN APPARATUS FOR INDIVIDUAL TRANSPORT OF OFFSET PRINTING PLATES

[75] Inventor: Peter Buus, Målov, Denmark

[73] Assignee: Eskofot A/S, Ballerup, Denmark

[21] Appl. No.: 673,815

[22] Filed: Mar. 22, 1991

[30] Foreign Application Priority Data

Mar. 22, 1990 [DK] Denmark ..... 0748/90

[51] Int. Cl.[5] ..... B41L 47/14

[52] U.S. Cl. ..... 101/477; 101/389.1; 101/483; 271/106; 271/107

[58] Field of Search ..... 101/389.1, 474, 476, 101/483, 492, 408, 407.1, 477, DIG. 36; 271/11, 91, 99, 100, 106-108, 267, 268; 355/99, 100

[56] References Cited

U.S. PATENT DOCUMENTS

| | | | |
|---|---|---|---|
| 4,402.497 | 9/1983 | Weibel et al. | 271/107 |
| 4,402.592 | 9/1983 | Schon et al. | 355/3 R |
| 4,767,113 | 8/1988 | Hasegawa et al. | 271/3 |
| 4,767,390 | 8/1988 | Herring | 271/100 |
| 4,848.764 | 7/1989 | Tajima et al. | 271/90 |
| 4,917,663 | 4/1990 | Pazdernik | 271/107 |
| 4,925,361 | 5/1990 | Ellis et al. | 271/107 |
| 4,968.019 | 11/1990 | Tanabe et al. | 271/106 |

FOREIGN PATENT DOCUMENTS

| | | | |
|---|---|---|---|
| 0037064 | 3/1981 | European Pat. Off. . | |
| 04836 | 1/1982 | Japan | 271/107 |
| 146927 | 4/1962 | U.S.S.R. | 271/107 |
| 717873 | 11/1954 | United Kingdom . | |

*Primary Examiner*—Clifford D. Crowder
*Assistant Examiner*—J. R. Keating
*Attorney, Agent, or Firm*—Cushman, Darby & Cushman

[57] ABSTRACT

A method for individual transfer of offset printing plates from a magazine in which the plates are supported at their lower edges and stacked with their respective non-coated sides facing upwards, to a receiving table. The receiving table receives each plate with the non-coated side of the plate facing downwards. The uppermost plate of the stack is gripped by a gripping device engaging the non-coated side of the plate in such a manner that the plate is retained by the gripping means during the transfer to the receiving table. The gripping device is caused to engage the plate adjacent its upper edge, and during the movement away from the stack, the gripping device is initially moved along a path within or along a circle which has its center in the lower edge of the plate, and which has a radius corresponding to the distance between the lower edge of the plate and the engagement point of the gripping means with the plate when the plate is being gripped, until the plate retained by the gripping device is essentially in line contact at its lower edge with the plate situated immediately therebelow in the stack.

7 Claims, 6 Drawing Sheets

METHOD AND AN APPARATUS FOR INDIVIDUAL TRANSPORT OF OFFSET PRINTING PLATES

BACKGROUND OF THE INVENTION

1. Field of the Invention

The invention relates to a method for individual transfer of offset printing plates from a magazine in which they are supported on their respective edges and stacked each with its non-coated side facing upwards, to a receiving table receiving a plate with its non-coated side facing downwards, and where the uppermost plate of the stack is gripped by means of a gripping means engaging the non-coated side of the plate in such a manner that said plate is retained by the gripping means during the transfer to the receiving table.

2. Background Art

EP-PS No. 0 037 064 discloses an apparatus for individual transport of printing plates. The printing plates are stacked in an inclined magazine with each with its non-coated side facing outwards and with intermediary protecting sheets arranged adjacent plates. The printing plates are transferred one by one from the magazine to a horizontally arranged conveyor advancing each plate to an exposure station. The apparatus comprises a pivotally arranged lifting cylinder, the displaceable piston rod of which is provided with suction means for gripping the uppermost plate in the stack and retaining that plate during the transfer to the conveyor. When a plate is to be gripped, the lifting cylinder is turned downwards into a position in which the piston rod thereof is arranged substantially perpendicular to the stack of plates. Subsequently, the piston rod is moved forwards until the suction means abut the surface of the uppermost plate. Then, the suction means are subjected to a vacuum in such a manner that they grip the plate, whereafter the piston rod is retracted in the cylinder until the plate has been slightly lifted from the plate therebelow. Then, pressurized air is blown between the plate lifted and the plate now on top of the stack, in such a manner that the protecting sheet is removed. Finally, the lifting cylinder is turned to its vertical position, with the effect that the plate levels with the conveyor path. When vacuum is no longer fed to the suction cups, the conveyor can advance the plates to the exposure station. The protecting sheets between the plates prevent the uppermost plate from adhering to the plate therebelow when said uppermost plate is being lifted from the stack. In addition, the protecting sheets protect, of course, the light-sensitive sides of the plates from being scratched when two plates are displaced relative to one another. The method and the apparatus of this prior art publication suffer, however, from the drawback of being rather complicated, partly due to the multitude of movements necessitating a multitude of mechanisms and partly due to the use of protecting sheets between the plates in the stack.

SUMMARY OF THE INVENTION

The object of the invention is to provide a method of the above type which, in a simple manner, insures that only the uppermost plate of the stack is gripped and transferred onto a receiving table, without the light-sensitive side of the plate being damaged, even when no protecting sheets are used between the plates in the stack.

The method according to the invention is characterized in that the gripping means is caused to engage the plate adjacent its upper edge, and, during the movement away from the stack, the gripping means is initially moved along a path within or along a circle with the centre in the lower edge having the plate and of a radius corresponding to the distance between the lower edge of the plate and the engagement point of the gripping means with the plate when the plate is being gripped, until the plate retained by the gripping means is essentially in line contact at its lower edge with the plate situated immediately therebelow in the stack. As a result, the lower edge of the uppermost plate is pressed against its support and the plate therebelow during the first step of the transfer with, the effect that it is subjected to a torque in a direction away from the stack. Consequently, the non-coated side of the plate is slightly concave, and, starting from the engagement point of the gripping means at the upper edge of the plate, the plate is rolled off the stack without being displaced relative to the plate therebelow until it is in line contact with the plate therebelow at its lower edge. In addition to preventing a damaging of the light-sensitive side of the plate facing downwards in the stack, the above described rolling off procedure ensures that the uppermost plate is completely released from the plate therebelow, due to the gradual elimination of the adhesion between the two plates.

According to the invention, the plate may at the upper end be subjected to a torque in a direction away from the stack when the gripping means is caused to engage the plate. In this manner, the uppermost plate is bent away from the stack at its upper edge, with the result that the plate is lifted from the stack before the transfer thereof is initiated. As a result, it is additionally ensured that the plate therebelow does not adhere to the uppermost plate and follow the movement thereof away from the stack.

The invention relates furthermore to an apparatus for carrying out the method according to the invention. The apparatus includes a plate magazine to accomodate a stack of plates with their non-coated sides facing outwards and for supporting these plates at their lower edges. The apparatus further includes a gripping means for gripping the uppermost plate in the stack by engaging the non-coated side thereof, where the gripping means is associated with a moving mechanism removing the gripped plate from the magazine and transferring it to a receiving table such that the plate is placed thereon with its non-coated side facing downwards.

The apparatus according to the invention is characterized in that the gripping means is adapted to grip the plate adjacent its upper edge, and that the moving mechanism is adapted during the removal of the plate from the stack to initially move the gripping means along a path within or along a circle with the centre in the lower edge of the plate and having a radius corresponding to the distance between the lower edge of the plate and the engagement point of the gripping means with the plate when the plate is being gripped, until the plate retained by the gripping means is essentially in line contact at its lower edge with the plate situated immediately therebelow in the stack. Because the uppermost plate of the stack is not displaced while being in surface contact with the plate therebelow, the light-sensitive side of the uppermost plate facing the plate therebelow is furthermore prevented from being damaged during the transport of the uppermost plate away from the plate therebelow. At the same time, the rolling off procedure ensures a gradual elimination of the adhesive forces between the two plates, such elimination starting at the upper edge of the uppermost plate, whereby the risk of more than one plate being removed from the stack is eliminated.

According to the invention, the moving mechanism may comprise a pivotal arm which at its lower end is rotatably journalled relative to a frame about a horizontal axis of rotation positioned below the lower edge of the stack of plates in the plate magazine, and which at its upper end is provided with a gripping means arm rotatably journalled about an axis parallel to the axis of rotation of the pivotal arm. The gripping means may be arranged on the gripping means arm at a distance from the axis of rotation thereof. The moving mechanism further includes a guiding means guiding the movement of the gripping means arm in the area adjacent the stack of plates in the magazine. The resulting embodiment of the invention turned out to be particularly advantageous in practice, especially when the gripping means arm according to a further embodiment of the invention is placed in front of the pivotal arm when seen in the moving direction from the magazine to the receiving table. In this manner, an embodiment of the invention is obtained where it is possible merely by a suitable choice of the gripping means arm to ensure that the lower edge of the plate is continuously pressed against its support and subjected to a torque suitable for ensuring the intended rolling off in the desired direction. At the same time, the guide means guiding the movement of the gripping means arm in the area adjacent the stack of plates is particularly simple, because the guide means need only guide the gripping means arm into the gripping position thereof immediately before the pivotal arm reaches the corresponding gripping position during its returning movement.

Furthermore, the pivotal arm may, according to the invention, be shaped substantially as an inverted L comprising a body member placed on one side of the magazine and the receiving table, as well as a transverse member, which at the upper end of the body member, extends towards the opposite side of the magazine and the receiving table, respectively. The transverse member may be arranged at a distance from the axis of rotation of the pivotal arm exceeding the distance between said axis of rotation and the upper edge of the plate magazine with plates arranged therein. The resulting embodiment turned out to be particularly suitable and space-saving in practice.

Moreover, according to the invention, the guide means may comprise a guide pin placed on the gripping means arm as well as a guide surface cooperating with the guide pin and placed in the frame. In this manner, a simple guiding of the movement of the gripping means arm and consequently of the gripping means is obtained, both when the guiding means is guiding the gripping means into its gripping position and when it is ensuring the specified path of the gripping means once the gripping means has gripped the plate or serves both purposes.

In addition, according to the invention, the gripping means may be formed by a plurality of suction cups aligned on a transverse support which is connected to the gripping means arm. As a result, offset printing plates made of all known material combinations and of varying widths can be gripped and retained by one and the same gripping means.

Moreover, according to the invention, the suction cups may be bellows-shaped such that their length is reduced when they are supplied with vacuum while abutting the plate so as to grip said plate, and a tilting edge may be present immediately below the suction cups. The tilting edge is placed immediately behind the engaging surface of the suction cup when seen in the moving direction. In this manner, the uppermost plate is slightly bent about the tilting edge when vacuum is supplied to the suction cups, with the result that the upper portion of the uppermost plate is released from the plate therebelow before the pivotal arm starts to transfer the plate.

Finally, according to the invention, the support may be tiltably connected to the gripping means arm, the tilting movement only being allowed in the same direction as the rotating direction of the pivotal arm, by means of a stop which determines the engaging position of the suction cups when the plate is being gripped. Accordingly, the plate gripped is prevented from being subjected to such a torque during the transfer that would provide the plate with an S-shaped bending curve when seen from the side, i.e. a bending curve having an inflexion.

BRIEF DESCRIPTION OF THE DRAWINGS

The invention is described in greater detail below with reference to the accompanying drawings, in which.

DESCRIPTION OF PREFERRED EMBODIMENTS

Figure 1:
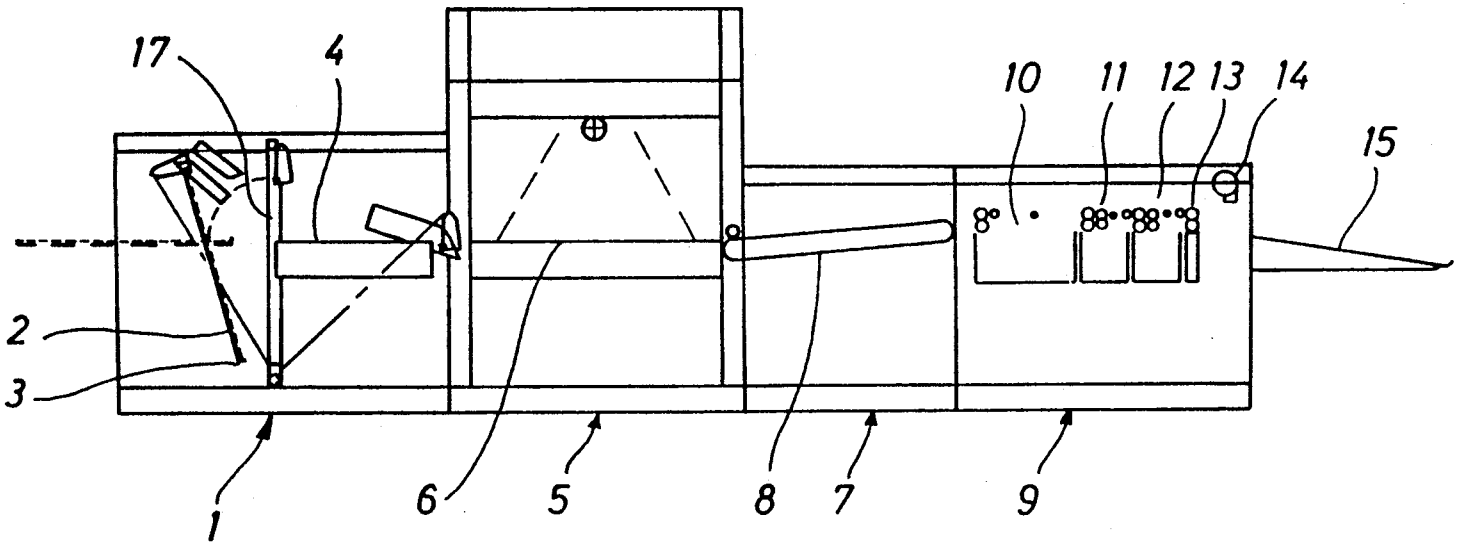
FIG. 1 is a diagrammatic, side elevation view of a machine for producing offset plates and including an apparatus according to the invention.

FIG. 1 is a diagrammatic side view of a machine for producing offset plates, i.e. for the exposure and developing thereof in such a manner that they are ready for printing use. The machine comprises a material unit 1 including an apparatus according to the invention. The apparatus comprises a magazine 3 which inclines relative to vertical and contains a stack 2 of plates. The apparatus comprises, furthermore, a roller conveyor 4 and a pivotal arm 17 with a gripping means transferring the uppermost plate of the stack onto the roller conveyor 4 which advances the plate to an exposure unit 5. When the plate has been positioned on an exposure table 6, the exposure unit 5 exposes the light-sensitive side of the plate. When seen in the moving direction of the plate through the machine, the exposure unit 5 is followed by a buffer unit 7 comprising a conveyor 8, which stores the exposed plate until the plate is advanced to a developing unit 9. The developing unit 9 has a developing section 10, a washing section 11, a fixing section 13, a rinsing section 12 and a drying section 14. Having passed these stations, the ready-made plate leaves the machine and is transferred to a delivery shelf 15.

Figure 2:
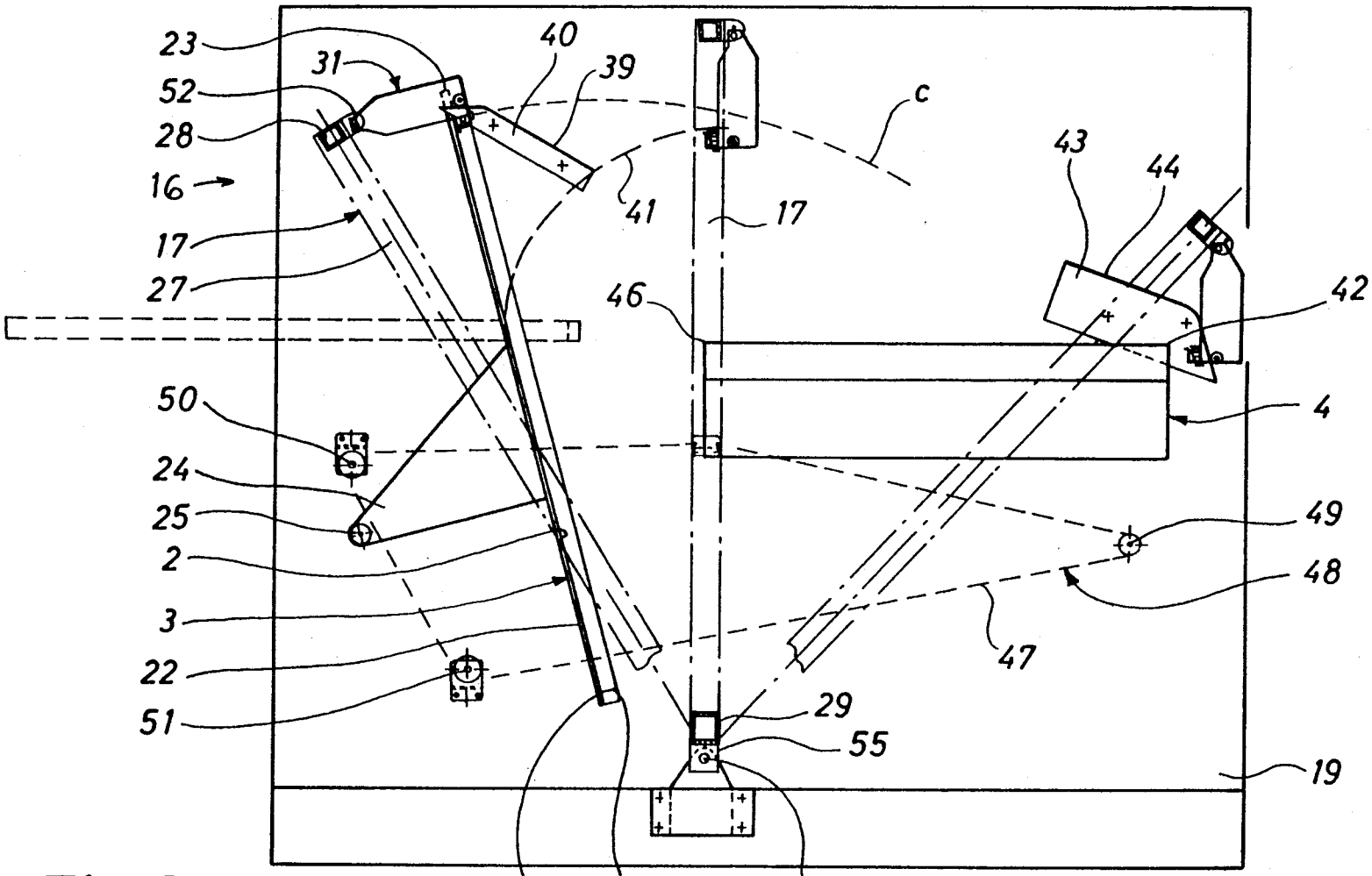
FIG. 2 is a diagrammatic, vertical, longitudinal sectional view through a first embodiment of the apparatus according to the invention.

FIG. 2 is a diagrammatic, more detailed view of a first embodiment of an apparatus 16 according to the invention. Below the magazine 3 and the conveyor 4, the pivotal arm 17 of the apparatus 16 is at its lower end rotatably journalled about a horizontal axis 18 relative to a frame 19. The plate magazine 3 is inclined relative to vertical, and, when seen from the side, the magazine 3 is arranged on one side of a vertical plane through the axis 18 of rotation of the pivotal arm. The horizontal roller conveyor 4 is substantially placed on the other side of the above mentioned vertical plane.

The pivotal arm 17 can be moved by means of a chain drive 47, between a gripping position shown to the left of FIG. 2, and a delivery position shown to the right of the Figure. The chain drive 47 comprises a chain 48 which is secured at its ends to the pivotal arm 17, a resilient member (not shown) and coupled to one end of the chain, a driving sprocket 49, which is driven by means of a motor (not shown) and which is rotatably journalled in a frame, as well as two idler sprockets 50, 51 which are also rotatably journalled in the frame.

In the plate magazine 3, the plates in the stack 2 are supported by a supporting member 21 at their lower edge 20. The plates are arranged with their light-sensitive sides facing the base 22 of the plate magazine. The supporting member 21 can be upwardly displaced relative to the position which is shown in FIG. 2, which position allows the largest possible height of plates capable of being stacked in the magazine 3. Accordingly, the upper edge 23 of the plates can be placed at the same location in the magazine irrespective of their size. Correspondingly, adjustable side guiding means 54*a*, 54*b* are arranged in the magazine in FIG. 4, these guiding means positioning the plates in response to their width. The plate magazine is pivotally connected to the frame 19 about a horizontal axis 25 of rotation through an arm 24 in such a manner that the magazine can be moved from the inclined position indicated by solid lines in FIG. 2, to the horizontal position which is indicated by dotted lines, and allowing a feeding of plates. In connection with the magazine 3, it should furthermore be noted that the plates are arranged in such a way that their upper edges 23 are flush with the upper edge 26 of the base 22 of the magazine 3, which appears clearly from FIG. 3.

Figure 3:
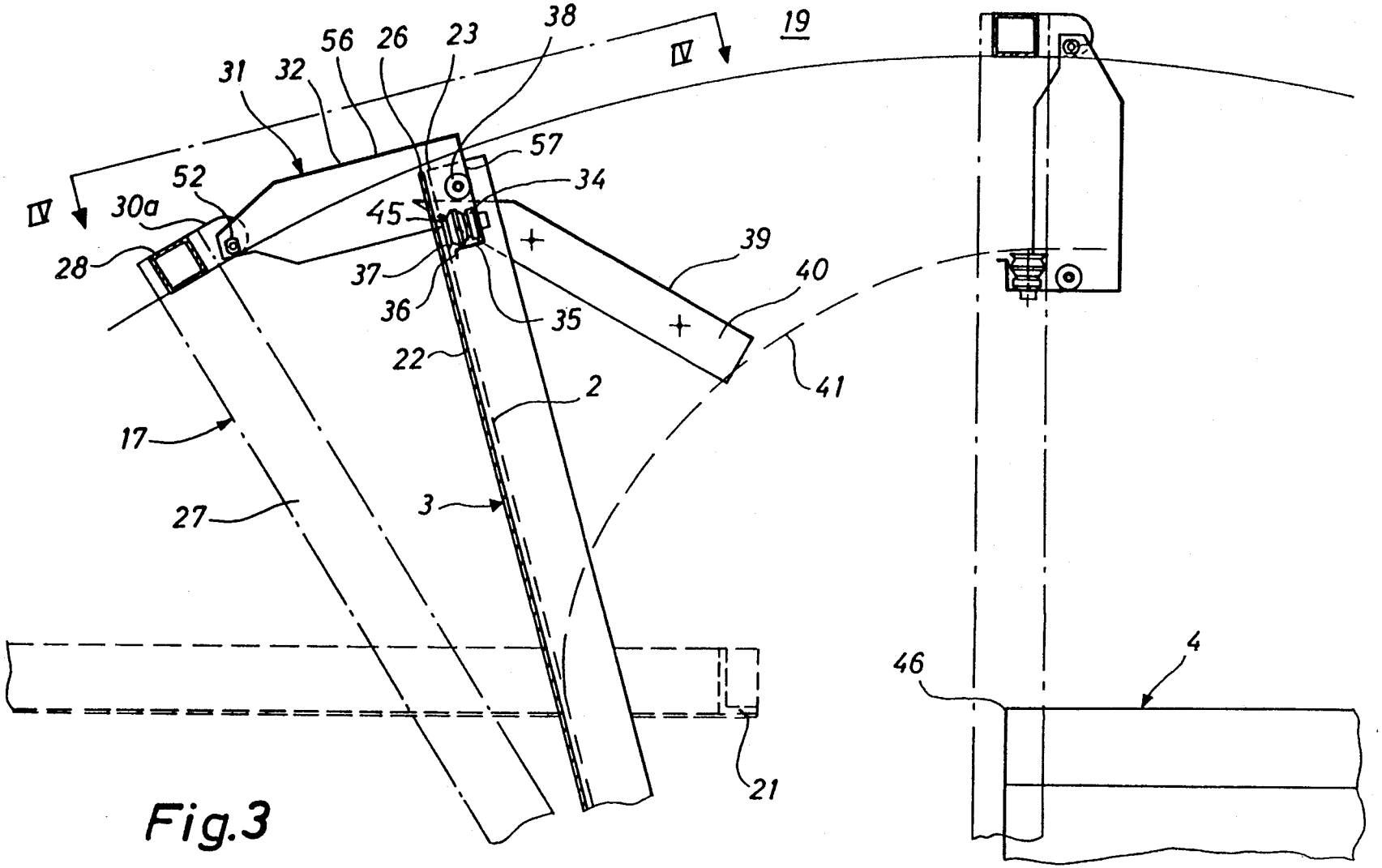
FIG. 3 is a gragmentary longitudinal sectional view on a larger scale of the embodiment of the invention shown in FIG. 2.
Figure 4:
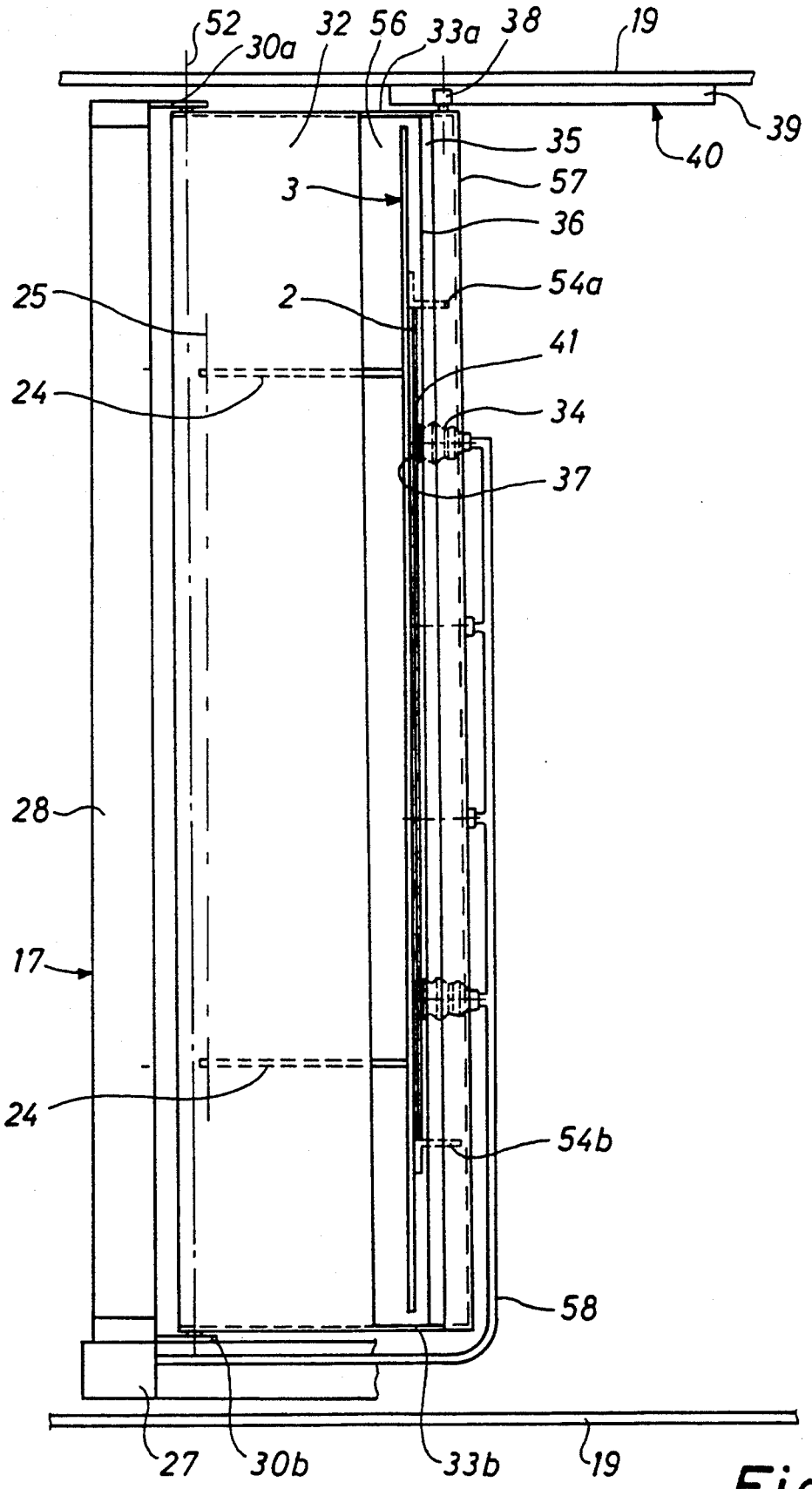
FIG. 4 illustrates the structure shown in FIG. 3 from the direction 4—4 of FIG. 3.

The pivotal arm 17 is shaped substantially like an inverted L with a body member 27 arranged on one side of the magazine 3 and the roller conveyor 4 as well as a transverse member 28 which extends towards and past the opposite side of the magazine 3 and the roller conveyor when seen from above as in FIG. 4. For the sake of good order, it should be mentioned that the body member of FIGS. 2 and 3 is indicated by dotted lines because it is not visible in these Figures due to its position (see FIG. 4) on the opposite side of the magazine and the conveyor, respectively. The pivotal arm 17 comprises, opposite the body member 27 and adjacent its lower end, a short arm 55 connected to the body member 27 by means of a lower transverse beam 29. The short arm and the lower end of the body member 27 are pivotally connected to the frame 19 so as to form the axis 18 of rotation of the pivotal arm 17. The upper transverse member 28 is placed at a distance from the axis 18 of rotation of the pivotal arm 17 which is greater than the distance between the axis 18 of rotation and the upper edge 23 of the stack 2 of plates in the magazine 3 and the upper edge 26 of said magazine 3, respectively, with the result that the upper transverse member 28 can pass the edges.

A bearing bracket 30*a*, 30*b* is arranged at each end of the upper transverse member 28. A gripping means or suction cup arm 31 is rotatably journalled on the bearing bracket about the axis 52 of rotation, this axis 52 of rotation being parallel to the axis 18 of rotation of the pivotal arm. The suction cup arm is made of bent sheet material and comprises an upper transverse wall 32 with an opening 56, as well as, at each end, an end wall 33*a*, 33*b* perpendicular to the transverse wall 32. The pivotal connection with the bearing brackets 30*a*, 30*b* is provided in the latter end walls. Opposite the above described pivotal connections with the bearing brackets 30*a* 30*b*, the suction cup arm 31 comprises a transverse supporting wall 57 provided with a transverse row of suction cups 34 which can be supplied with vacuum through a tube 58. Immediately below the row of suction cups, the supporting wall 57 continues into a tilting part 35 which extends towards the gripping surface 37 of the suction cups and ends in a tilting edge 36 immediately before the gripping surface 37 in the non-activated state of the suction cups, i.e. when the suction cups are not subjected to vacuum. As clearly illustrated in FIGS. 3 and 4, the suction cups 34 are bellows-shaped such that when loaded they will try to reduce their length to such an extend that their gripping surface 37 is moved to the other side of the tilting edge 36. A roller 38 is mounted on one end wall 33*a* of the suction cup arm 31, this roller being adapted to roll on a guide surface 39 of a guide rail 40 arranged on the inner side of the frame 19 in an area adjacent the upper end of the plate magazine. The guide surface 39 serves to guide (see FIGS. 2, 3 and 4) the suction cup arm 31 into a position in which the gripping surface 37 of the suction cups is substantially level with the uppermost plate 41 in the stack of plates, whereby the uppermost plate 41 may be gripped and transferred onto the roller conveyor 4.

A guide rail 43 is also secured to the inner side of the frame 19 in the area adjacent the edge 42 of the roller conveyor 4 farthest from the axis 18 of rotation of the pivotal arm 17. The guide rail 43 serves to guide the movement of the suction cup arm 31 immediately before a plate is placed on the roller conveyor 4, and when the pivotal arm is returned towards the plate magazine 3 after the plate has been released so as to grip another plate.

When the uppermost plate 41 in the stack 2 of plates is to be transferred onto the roller conveyor 4, the pivotal arm 17 is moved out of a resting position, such as the vertical position of FIGS. 2 and 3, and towards the stack 2 of plates. As a result, the roller 38 on the suction cup arm 31 is moved into contact with the guide surface 39 of the guide rail 40, with the effect that the suction cups 34 are moved into their gripping position when the pivotal arm 17 reaches its gripping position, which is shown to the left in FIGS. 2 and 3. When vacuum is supplied to the suction cups 34 in the above described gripping position, the cups grip the uppermost plate 41 in the stack 2 adjacent the upper edge of the plate. The bellows-shaped form of the suction cups and the tilting edge 36 immediately below the row of suction cups 34 imply that the upper end of the plate is lifted from the plate therebelow. Subsequently, the pivotal arm 17 is moved to the right towards the roller conveyor 4. Due to the weight and dimensions of the suction cup arm and due to the positioning of the various parts of the apparatus, the suction cups are moved along a path during the above described movement. The path is placed within or along a circle C with the centre in the supporting point of the gripped plate 41 against the supporting plate 21 and having a radius corresponding to the distance between the supporting point and the engagement point 45 of the suction cups 34 with the plate when the plate is gripped in the magazine 3. The suctions cups follow the above-described path, until the gripped plate 41 is essentially in line contact with the plate therebelow at its lower edge. As a result, the gripped plate 41 is gradually rolled off the plate therebelow while forming a curve when seen from the side. While the plates are in surface contact, no relative displacement occurs therebetween, with the result that the risk of damaging the light-sensitive surface facing inwards of the gripped plate has been eliminated. In this connection, it should be noted that it is important that the contact surface of the plate towards the plate therebelow is not broken during the entire separating procedure, whereby no relative displacement occurs of the gripped plate relative to the plate therebelow. During the continued movement of the pivotal arm 17 towards the roller conveyor 4, the lower edge of the gripped plate 41 is at a time lifted off the supporting member 21 and slides along the upper surface of the plate therebelow. At the same time, the side of the gripped plate facing upwards in the magazine slides on the upper front edge 46 of the roller conveyor so as to end up facing downwards on the roller conveyor.

Before the pivotal arm 17 reaches the delivery position indicated to the right in FIG. 2, the roller 38 of the suction cup arm 31 abuts the guide surface 44 of the guide rail 43, with the result that the suction cup arm 31 is guided into the delivery position of the plate. In the delivery position, the supply of vacuum is interrupted to the suction cups, with the effect that the plate is released and can be advanced by means of the roller conveyor onto the exposure table 6 of the exposure unit 5, the plate thereby passing through the opening 56 in the transverse wall 32 of the suction cup arm 31. When the pivotal arm is returned from the delivery position to its vertical position, the movement of the suction cup arm 31 is guided by the contact of the roller 38 with the guide surface 44. In response to the rigidity and height of the plate relative to the weight of the suction cup arm, the movement of the suction cup arm 31 is, of course, also guided by the contact of the roller 38 with the guide surface 39 of the guide rail 40 during the removal of the uppermost plate from the stack.

Figure 5:
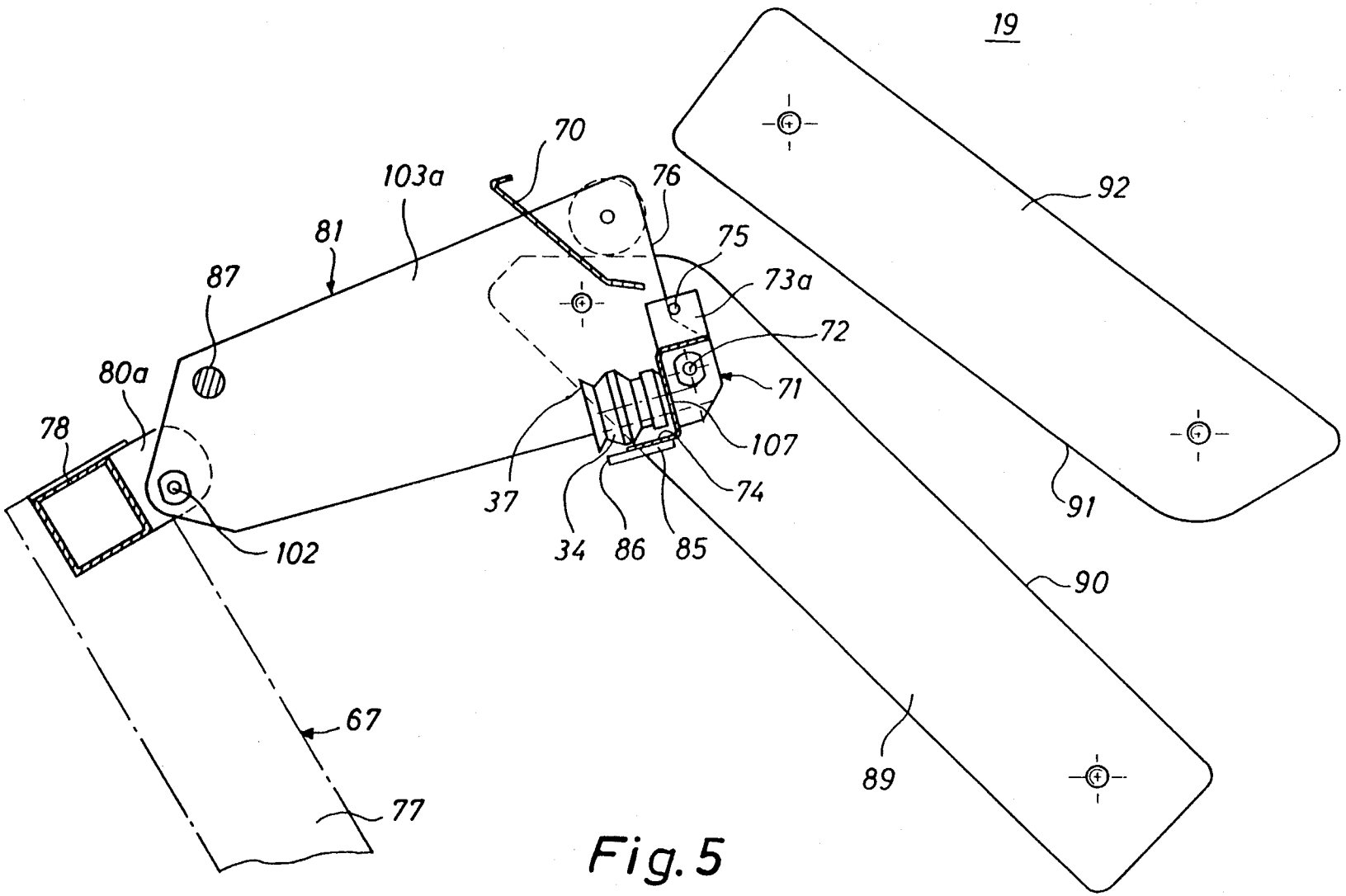
FIG. 5 is a fragmentary longitudinal sectional view, similar to FIG. 3, but of an alternative embodiment of the invention.
Figure 6:
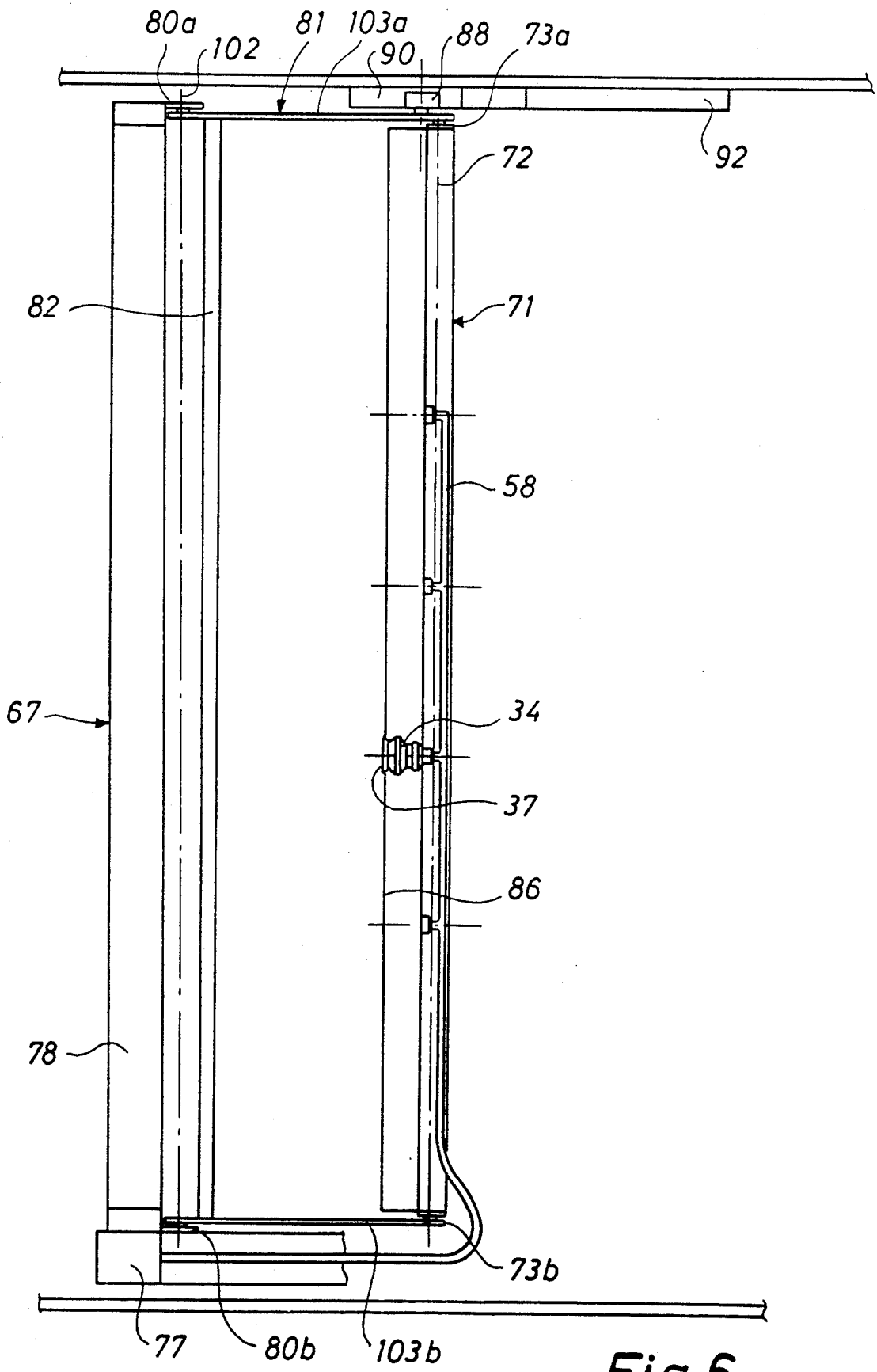
FIG. 6 is a fragmentary plan view, similar to FIG. 4, but of the structure shown in FIG. 5, from the direction 6—6 indicated in FIG. 5.

FIGS. 5 and 6 are a longitudinal sectional view and a fragmentary plan view, respectively, in the direction 6—6 of FIG. 5 of an alternative embodiment of the invention corresponding to the embodiment indicated in FIG. 1. The embodiment of FIGS. 5 and 6 corresponds in all respects to the embodiment of FIGS. 2 to 4, apart from the details shown in particular in FIGS. 5 and 6, the reason why only the shown details are described below.

FIGS. 5 and 6 illustrate the pivotal arm 67 in the gripping position. The pivotal arm 67 comprises a body member 77 and an upper transverse member 78. A bearing bracket 80*a*, 80*b* is secured at the upper end of the transverse member. A suction cup arm 81 is pivotally connected to the bearing brackets 80*a*, 80*b* about an axis 102 of rotation. The suction cup arm 81 comprises two end members 103*a*, 103*b* providing the bearing presenting the axis 102 of rotation. The suction cup arm 81 comprises, furthermore, a transverse connecting rod 82 and a guide plate 70 interconnecting the two end members. The guide plate 70 guides the plate in the delivery position (not shown) of the pivotal arm 67 when the plate is advanced by the roller conveyor 4 onto the exposure table 6 (see FIG. 1) of the exposure unit 5.

A suction cup beam 71 of a Z-shaped cross-section and with two side members 73*a*, 73*b* is rotatably connected with the end members 103*a*, 103*b* of the suction cup arm 81 opposite the axis 102 of rotation between the suction cup arm 81 and the pivotal arm 67, this rotatable connection defining an axis 72 of rotation. The body 107 of the suction cup beam 71 is provided with a transverse row of suction cups 34 corresponding to the suction cups referred to in FIGS. 2 and 4, and which can be supplied with vacuum through the tube 58. One leg 74 of the suction cup beam 71 extends immediately below the row of suction cups 34 in a direction towards the gripping surfaces 37 of the suction cups. A tilting part 85 with a tilting edge 86 is adjustably arranged on the leg 74. In the non-activated state of the suction cups 34 and when the pivotal arm 67 is moved towards the magazine so as to grip the uppermost plate therein, the tilting edge 86 is placed immediately behind the gripping surface 37 of the suction cups. The lengths of the suction cups 34 is reduced, as previously described, when the suction cups are supplied with vacuum.

A stop pin 75 extends outwardly of one side member 73*a* of the suction cup beam 71. The stop pin is adapted counter-clockwise (see FIG. 5) to limit the turning of the suction cup beam 71 to the position of FIG. 5, by providing an abutment against the edge surface 76 of the adjacent end member 103*a* of the suction cup arm 81. The suction cup beam 71 is allowed to turn freely clockwise about the axis 72 of rotation (see FIG. 5). The pivotal mounting of the suction cup beam 71, and consequently of the suction cups, prevents the gripped plate from being subjected to a torque during the transfer which would otherwise have provided the plate with an S-shaped bending curve, i.e. a curve having an inflexion, and which would have deformed the plate unecessarily.

Finally, a roller 88 is rotatably journalled on the outer side of the end member 103*a* of the suction cup arm 81. The roller 88 is adapted to roll on an upper guide surface 90 of a lower guide rail 89 and a lower guide surface 91 of an upper guide rail 92, these guide rails being placed on the inner side of the frame 19 in an area adjacent the upper end of the plate magazine. The upper guide surface 90 of the lower guide rail 89 is adapted to limit the convex bending of the gripped plate when the plate is being removed from the stack of plates. The guide surface 90 is furthermore adapted to guide the suction cup arm 81 into the position corresponding to the gripping position of the suction cups 34 when the pivotal arm 67 is moved from the delivery position to the gripping position of FIG. 5. The lower guide surface 91 of the upper guide rail 92 is adapted to provide the gripped plate with the desired bending independent of the rigidity thereof.

The invention may be modified in many ways without thereby deviating from the principles thereof. Thus, the movement of the suction cup arm may, for instance, during the entire transferring movement of the pivotal arm and during the entire returning movement thereof, be limited by a lower and an upper guide as indicated by means of the guides 89 and 92 in the area adjacent the gripping position of the pivotal arm. Furthermore, the angular turning of the suction cup beam may be forcibly guided during the movement of the pivotal arm so as to achieve the desired curving of the plate. The forced guiding can, for instance like the guiding of the suction cup arm 81, be provided by means of a guide pin and guide plates. Correspondingly, the suction cup beam can advantageously be guided by means of other mechanisms beyond a pivotal arm and a suction cup arm, such as by means of a chain, guides and guideways for providing the desired moving path for the suction cup beam.

I claim:

1. A method for successively transferring generally rectangular flexible offset printing plates each having a coated side and a non-coated side and bonding edges including an upper edge and a lower edge, from an obliquely oriented stack in which the printing plates are jointly supported on their respective lower edges and coated sides on a support structure located upstream of a vertically, transversally oriented notional plane, relative to a generally horizontally oriented, upwardly facing support surface which is located downstream of said plane, in which each plate relatively uppermost plate in said stack until being removed from said stack, is disposed with the coated side thereof in substantially coextensive extensive face-to-face engagement with the uncoated side of a respective next lowermost plate in said stack, with the lower edge thereof supported at a given generally horizontal level by a portion of said support structure, said method comprising:

(a) gripping the uppermost one of said plates, on the non-coated side thereof, along a substantially horizontal line of engagement which is adjacent but below the upper edge thereof using a gripping device;

(b) moving said gripping device along an arcuate path from said stack, towards said upwardly facing support surface, from upstream of to downstream of said plane, which arcuate path lies entirely within or on a circular arc which is centered on the lower edge of said uppermost one of said plates and has a radius equal to the shortest distance along the non-coated side of said uppermost one of said plates from the lower edge thereof to said line of engagement, until said uppermost one of said plates has become so concave away from said stack that said coated side of said uppermost one of said plates contacts said non-coated side of the respective next lowermost one of said plates only along a line which coincides with the lower edge of said uppermost one of said plates, then continuing to move said gripping device away from said stack along a further arcuate path, until the plate gripped thereby has become supported non-coated side down on said support surface;

(c) releasing from said gripping device the plate gripped thereby;

(d) moving said gripping device back through said plane towards said stack; and (e) conducting steps (a)–(d) a plurality of times, each on a successive uppermost one of said plates.

2. The method of claim 1, wherein:

during steps (a) and (b), the respective plate is gripped to the gripping device by drawing suction through a horizontal row of suction cups provided on the gripping device.

3. The method of claim 2, wherein:

as step (a) is being initiated, said suction cups are oriented generally horizontally towards the non-coated side of the uppermost one of said plates, and are first brought into contact with that non-coated side and then have suction drawn therethrough such as to axially foreshorten said suction cups and thereby initiate curving of the uppermost one of said plates away from said stack, from adjacent the upper edge of said uppermost one of said plates.

4. The method of claim 1, wherein:

each successive uppermost one of said sheets is rotated by movement of said gripping means through more than 90 degrees in being transferred from said stack to said support surface.

5. Apparatus for successively transferring generally rectangular flexible offset printing plates each having a coated side and a non-coated side and bonding edges including an upper edge and a lower edge, from an obliquely oriented stack in which the printing plates are jointly supported on their respective lower edges and coated sides on a support structure located upstream of a vertically, transversally oriented notional plane, relative to a generally horizontally oriented, upwardly facing support surface which is located downstream of said plane, in which each plate relatively uppermost plate in said stack until being removed from said stack, is disposed with the coated side thereof in substantially coextensive extensive face-to-face engagement with the uncoated side of a respective next lowermost plate in said stack, with the lower edge thereof supported at a given generally horizontal level by a portion of said support structure, said apparatus comprising:

(a) means for gripping the uppermost one of said plates, on the non-coated side thereof, along a substantially horizontal line of engagement which is adjacent but below the upper edge thereof using a gripping device; and (b) means for moving said gripping device along an arcuate path from said stack, towards said upwardly facing support surface, from upstream of to downstream of said plane, which arcuate path lies entirely within or on a circular arc which is centered on the lower edge of said uppermost one of said plates and has a radius equal to the shortest distance along the non-coated side of said uppermost one of said plates from the lower edge thereof to said line of engagement, until said uppermost one of said plates has become so concave away from said stack that said coated side of said uppermost one of said plates contacts said non-coated side of the respective next lowermost one of said plates only along a line which coincides with the lower edge of said uppermost one of said plates, then continuing to move said gripping device away from said stack along a further arcuate path, until the plate gripped thereby has become supported non-coated side down on said support surface;

said gripping means being operable for releasing from said gripping device the plate gripped thereby onto said support surface, and said moving means being operable for moving said gripping device back through said plane towards said stack so that said gripping means can grip a successive uppermost one of said plates for transfer to said support surface.

6. The apparatus of claim 5, wherein:

said gripping device comprises a horizontal row of suction cups and means for drawing suction therethrough.

7. The apparatus of claim 5, further including means for orienting said suction cups generally horizontally towards the non-coated side of the uppermost one of said plates and bringing said suction cups into contact with that non-coated side of said uppermost one of said plates at said horizontal line of engagement, and then operating said drawing means for drawing suction through said suction cups such as to axially foreshorten said suction cups and thereby initiate curving of the uppermost one of said plates away from said stack, from adjacent the upper edge of said uppermost one of said plates for initiating transfer of said uppermost one of said plates from said stack to said support surface.

* * * * *